US008643546B2

(12) United States Patent
Wu et al.

(10) Patent No.: US 8,643,546 B2
(45) Date of Patent: Feb. 4, 2014

(54) RADIATION PATTERN INSULATOR AND MULTIPLE ANTENNAE SYSTEM THEREOF AND COMMUNICATION DEVICE USING THE MULTIPLE ANTENNAE SYSTEM

(75) Inventors: Chun-Yih Wu, Taichung (TW); Hung-Hsuan Lin, Taipei (TW); Ken-Huang Lin, Kaohsiung (TW); Hsin-Lung Su, Kaohsiung (TW); Chih-Chun Hsu, Taipei (TW)

(73) Assignees: Industrial Technology Research Institute, Hsinchu (TW); National Sun Yat-sen University, Kaohsiung (TW)

( * ) Notice: Subject to any disclaimer, the term of this patent is extended or adjusted under 35 U.S.C. 154(b) by 584 days.

(21) Appl. No.: 12/622,438

(22) Filed: Nov. 20, 2009

(65) Prior Publication Data

US 2010/0295739 A1 Nov. 25, 2010

(30) Foreign Application Priority Data

May 21, 2009 (TW) ..... 98116864 A

(51) Int. Cl.
*H01Q 1/38* (2006.01)
*H01Q 21/00* (2006.01)

(52) U.S. Cl.
USPC ..... 343/700 MS; 343/853; 343/893

(58) Field of Classification Search
None
See application file for complete search history.

(56) References Cited

U.S. PATENT DOCUMENTS 5,952,983 A 9/1999 Dearnley et al.
6,515,633 B2 2/2003 Ippolito
6,822,609 B2 * 11/2004 Mendolia et al. ..... 343/700 MS
6,954,177 B2 10/2005 Channabasappa et al.
7,352,328 B2 4/2008 Moon et al.
7,385,563 B2 6/2008 Bishop
7,450,080 B2 11/2008 Stephens
2006/0279465 A1 * 12/2006 Moon et al. ..... 343/700 MS
2007/0285336 A1 * 12/2007 Kamgaing ..... 343/895
2011/0152725 A1 * 6/2011 Demir et al. ..... 600/587

OTHER PUBLICATIONS

Aycan Erentok et al. "Characterization of a Volumetric Metamaterial Realization of an Artificial Magnetic Conductor for Antenna Applications", IEEE Transactions on Antennas and Propagation, vol. 53, No. 1, Jan. 2005, pp. 160-172.
"Search Report of European Counterpart Application", issued on Aug. 27, p. 1-p. 7, in which the listed references were cited.
Bait Suwailam, M.M. et al., "Mutual coupling reduction in MIMO antennas using artificial magnetic materials", Antenna Technology and Applied Electromagnetics and the Canadian Radio Science Meeting, 2009. ANTEM/URSI 2009. 13th International Symposium on, IEEE, Piscataway, NJ, USA, Feb. 15, 2009, pp. 1-4, XP031444129, IBSN: 978-1-4244-2979-0.

(Continued)

*Primary Examiner* — Trinh Dinh
(74) *Attorney, Agent, or Firm* — Jianq Chyun IP Office

(57) ABSTRACT

A radiation pattern insulator and an antennae system thereof are proposed. The radiation pattern insulator includes a dielectric substrate and a plurality of radiation pattern insulation elements. The dielectric substrate allocated between a plurality of antennae includes a top surface and a bottom surface, and a normal direction of the dielectric substrate is substantially perpendicular to propagation directions of electromagnetic waves radiated from the antennae. In addition, the radiation pattern insulation elements are allocated on the top surface or the bottom surface of the dielectric substrate, or alternatively, all allocated on the top surface and the bottom surface.

11 Claims, 9 Drawing Sheets

(56) References Cited

OTHER PUBLICATIONS

In Kwang Kim, "Effect of capacitive coupling between split-ring resonators", Antennas and Propagation Society International Symposium, 2008. AP-S 2008. IEEE, IEEE, Piscataway, NJ, USA, Jul. 5, 2008, pp. 1-4, XP031342924, ISBN: 978-1-4244-2041-4.

Erentok, A. et al., "Numerical Analysis of a Printed Dipole Antenna Integrated With a 3-D AMC Block", Antennas and Wireless Propagation Letters, IEEE, Piscataway, NJ, US LINKDDOI: 10.1109/LAWP.2007.893107, vol. 6, Jan. 1, 2007, pp. 134-136, XP011222340, ISBN: 1536-1225.

Ferrer, P.J. et al., "Bidirectional metamaterial separator for compact antenna systems", Antennas and Propagation Society International Symposium, 2007, IEEE, IEEE, Piscataway, NJ, USA, Jun. 1, 2007, pp. 1893-1896, XP031169533, ISBN: 978-1-4244-0877-1.

* cited by examiner

RADIATION PATTERN INSULATOR AND MULTIPLE ANTENNAE SYSTEM THEREOF AND COMMUNICATION DEVICE USING THE MULTIPLE ANTENNAE SYSTEM

CROSS-REFERENCE TO RELATED APPLICATION

This application claims the priority benefit of Taiwan application serial no. 98116864, filed on May 21, 2009. The entirety of the above-mentioned patent application is hereby incorporated by reference herein and made a part of this specification.

BACKGROUND OF THE INVENTION

1. Technical Field

The present disclosure generally relates to a radiation pattern insulator and more particularly to a radiation pattern insulator in a multiple antennae system, the antenna system, and the communication device using the same.

2. Background

The current wireless communication system usually adopts the multiple input multiple output (MIMO) wireless transmission technology, such as the wireless communication system of standard 802.11n or the worldwide interoperability for microwave access (WiMAX) system adopting standard 802.16, so as to increase the data transmission rate by increasing the wireless channel number. However, to achieve the object of the MIMO technology, the communication device of the user must have multiple antennae. If the distance of the multiple antennae on the communication device is not far enough, the wireless signals will be mutually coupled when the multiple antennae receive or transmit the electromagnetic waves of the wireless signals, so that the insulation of the multiple antennae will be decreased, and thus the total capacity of the wireless channels will be decreases. Hence, it is important to efficiently increase insulation of the multiple antennae for the MIMO technology and the communication device with multiple antennae.

Several conventional methods for increasing insulation of the multiple antennae are proposed and described as follows. One method is to increase the distance of the multiple antennae. However this method needs much space to be occupied, and is not suitable for the hand-held or small volume communication device, such as the mobile phone, the notebook, or the personal data processing apparatus. Another method is to use multiple antennae with different polarizations and radiation patterns. However, when the hand-held or small volume communication device adopts this method, it is hard to obtain the pure polarization or the definite radiation. Another method is to use the hybrid coupler to achieve the diversity of the wireless signals, and another method is to use the single insulation architecture, such as passive antennae. Another method is to use the period insulation architecture, but this method may deduce a narrow frequency band.

SUMMARY

An exemplary example of the radiation pattern insulator is provided. The radiation pattern insulator includes a dielectric substrate and a plurality of radiation pattern insulation elements. The dielectric substrate is allocated between a plurality of antennae, and includes a top surface and a bottom surface, and a normal direction of the dielectric substrate is substantially perpendicular to propagation directions of electromagnetic waves radiated from the antennae. In addition, the radiation pattern insulation elements are allocated on the top surface or the bottom surface of the dielectric substrate, or alternatively, all allocated on the top surface and the bottom surface.

Another exemplary example of the multiple antennae system is provided. The multiple antennae system comprises at least two antennae and at least a radiation pattern insulator. The two antennae have same operating frequencies, and each of the two antennae comprises a radiation conductor, a conductor ground surface, and a feed-in end. The at least one radiation pattern insulator allocated between the two antennae comprises a plurality of radiation pattern insulation elements and a dielectric substrate. The radiation pattern insulation elements are allocated on the top surface or the bottom surface of the dielectric substrate, or alternatively, all allocated on the top surface and the bottom surface.

Another exemplary example of a communication device is provided. The communication device comprises a multiple antennae system, at least a radiation pattern insulator, and a wireless communication unit. The multiple antennae system is used to receive and transmit a plurality of wireless signal. The at least a radiation pattern insulator is allocated in the multiple antennae system, and comprises a plurality of radiation pattern insulation elements and a dielectric substrate, wherein the radiation pattern insulation elements are allocated on a top surface or a bottom surface of the dielectric substrate, or alternatively, all allocated on the top surface and the bottom surface of the dielectric substrate. The wireless communication unit is used to process the wireless signals.

Another exemplary example of a radiation pattern insulator is provided. The radiation pattern insulator comprises a dielectric substrate, a tree shape insulation element, and a plurality of radiation pattern insulation elements. The dielectric substrate allocated between a plurality of antennae comprises a top surface and a bottom surface. A normal direction of the dielectric substrate is substantially perpendicular to propagation directions of a plurality of electromagnetic waves radiated from the antennae. The tree shape insulation element is allocated on the top surface or the bottom surface on the dielectric substrate. The radiation pattern insulation elements are allocated on the top surface or the bottom surface of the dielectric substrate.

An exemplary example of a multiple antennae system is provided. The multiple antennae system comprises at least two antennae and at least a radiation pattern insulator. The two antennae have same operating frequencies, and are monopole antennae. Each of the two antennae comprises a radiation conductor, a conductor ground surface, and a feed-in end. The at least one radiation pattern insulator allocated between the two antennae comprises a tree shape insulation element, a plurality of radiation pattern insulation elements, and a dielectric substrate, wherein the tree shape insulation element is allocated on a top surface or a bottom surface of the dielectric substrate, and is electrically connected to the conductor ground surface.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate exemplary examples of the present invention and, together with the description, serve to explain the principles of the exemplary examples of the present invention.

DESCRIPTION OF THE EMBODIMENTS

Figure 1:
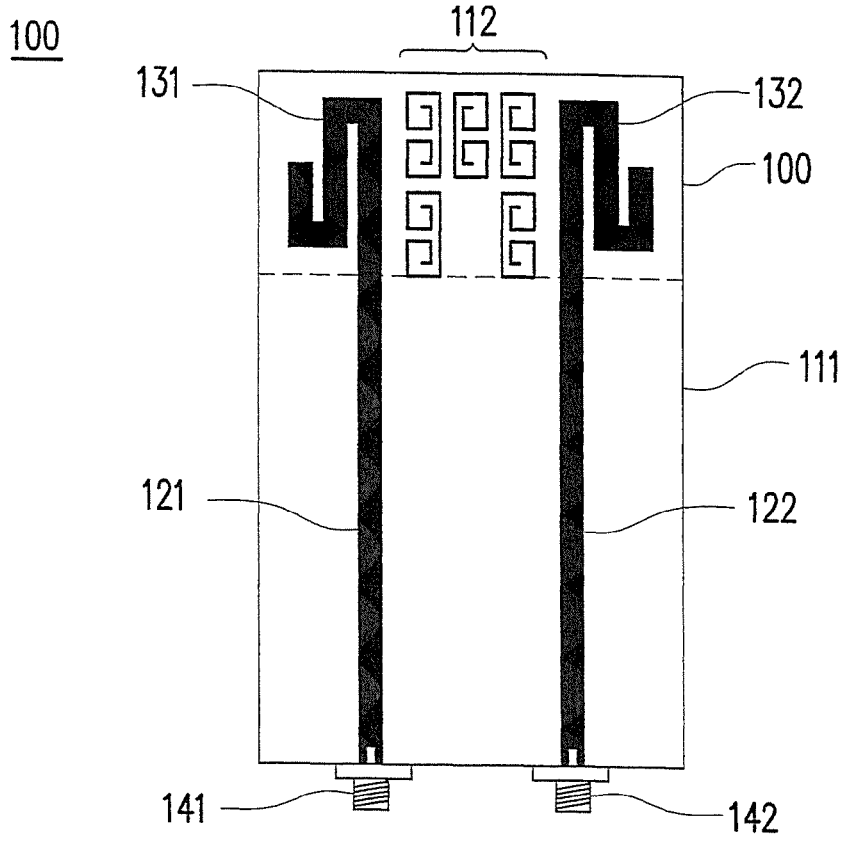
FIG. 1 is a schematic representation of the architecture of the multiple antennae system according to an exemplary example.

Reference will now be made in detail to the present exemplary examples of the present invention, exemplary examples of which are illustrated in the accompanying drawings. Wherever possible, the same reference numbers are used in the drawings and the description to refer to the same or like parts.

Exemplary examples of a radiation pattern insulator, a multiple antennae system with a radiation pattern insulator, and a communication with the multiple antennae system are provided. In the exemplary example, the radiation pattern insulator has a property of broadband. Besides the following exemplary example are used to describe the present invention, and are not intended to limit the present invention.

Referring to FIG. 1, FIG. 1 is a schematic representation of the architecture of the multiple antennae system 100 according to an exemplary example of the present disclosure. The multiple antennae system 100 is capable of being applied on a communication device adopting a multiple input multiple output transmission technology, or on a communication device having a plurality of high frequency antenna units. The multiple antennae system 100 comprises a conductor ground surface 111, a radiation pattern insulator 112, a first microstrip conductive line 121, a second microstrip conductive line 122, a first radiation conductor 131, a second radiation conductor 132, a first feed-in end 141, and a second feed-in end 142.

In one exemplary example, it is assumed that the communication device (not shown) has previously separated the frequency signal into a first frequency signal (not shown) and a second frequency signal (not shown), and the first frequency signal and the second frequency signal feed into the multiple antennae system 100 via the first feed-in end 141 and the second feed-in end 142. In other words, the first and second frequency signals respectively feed into the first microstrip conductive line 121 and the second microstrip conductive line 122 of the multiple antennae system 100. The first microstrip conductive line 121 and the second microstrip conductive line 122 respectively transmit the first and second frequency signals to the first radiation conductor 131 and the second radiation conductor 132, so as to emit the first and second frequency signals. In other words, the first radiation conductor 131 and the second radiation conductor 132 are antennae of the multiple antennae system 100, and particularly the first radiation conductor 131 and the second radiation conductor 132 are the monopole antennae.

On the contrary, when the first radiation conductor 131 and the second radiation conductor 132 receives a frequency signal (not shown), the first radiation conductor 131 and the second radiation conductor 132 respectively transmit the received frequency signals to the first microstrip conductive line 121 and the second microstrip conductive line 122. Then the first microstrip conductive line 121 and the second microstrip conductive line 122 respectively transmit the received frequency signals via the first feed-in end 141 the second feed-in end 142 to the other modules (not shown) or the other units (not shown) of the communication device, so as to process the received frequency signals.

Referring to FIG. 1, the conductor ground surface 111 of the multiple antennae system 100 provides a ground to the first microstrip conductive line 121, the second microstrip conductive line 122, the first radiation conductor 131, and the second radiation conductor 132 of the multiple antennae system 100. Besides, the first microstrip conductive line 121 and the second radiation conductor 132 are respectively allocated on the two sides of the radiation pattern insulator 112. Meanwhile, the first microstrip conductive line 121 and the second radiation conductor 132 are respectively allocated on the two sides of the radiation pattern insulator 112. The radiation pattern insulator 112 changes radiation patterns of the electromagnetic waves radiated from the first radiation conductor 131 and the second radiation conductor 132, and thus reduces mutual coupling of the first radiation conductor 131 and the second radiation conductor 132.

Figure 3:
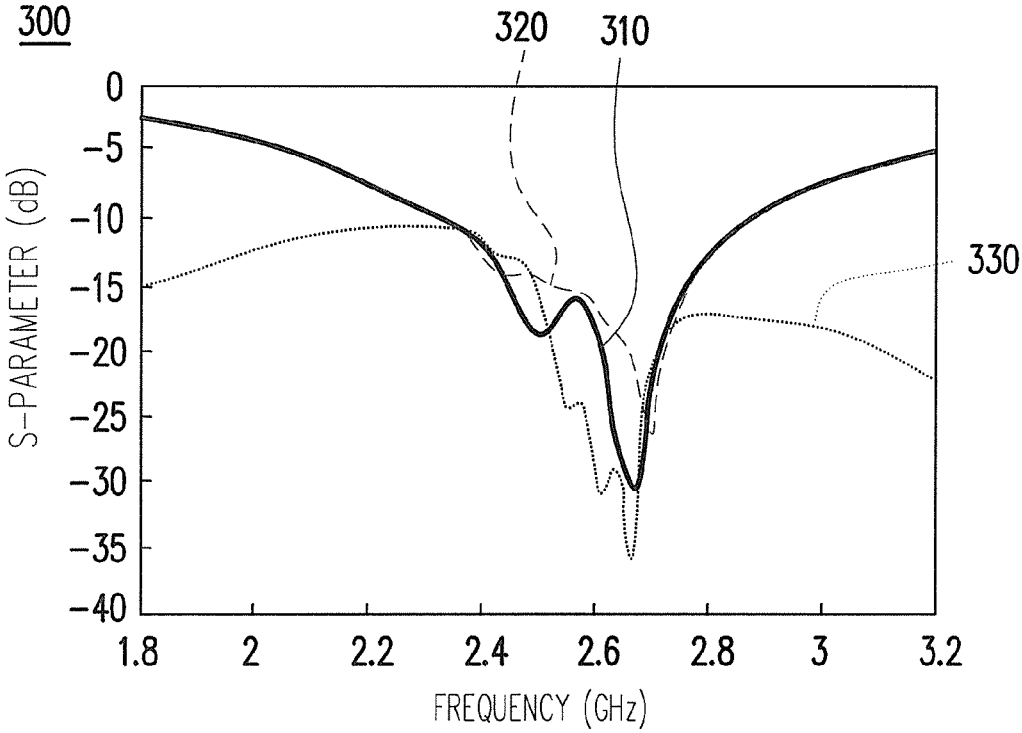
FIG. 3 is a graph showing the curves of the return loss and the coupling coefficient of the multiple antennae system according to the exemplary example.

FIG. 3 is a graph showing the curves of the return loss and the coupling coefficient of the multiple antennae system 100 according to the exemplary example of the present disclosure. It is noted that FIG. 3 shows the return losses and the coupling coefficient of the first radiation conductor 131 and the second radiation conductor 132 of the multiple antennae system 100, after reducing mutual coupling of the first radiation conductor 131 and the second radiation conductor 132 by using the radiation pattern insulator 112. Please see FIG. 3, the curve 310 of FIG. 3 represents the return loss of the first radiation conductor 131, the curve 320 of FIG. 3 represents the return loss of the second radiation conductor 132, and the curve 330 of FIG. 3 represents the coupling coefficient of the first radiation conductor 131 and the second radiation conductor 132.

Figure 4:
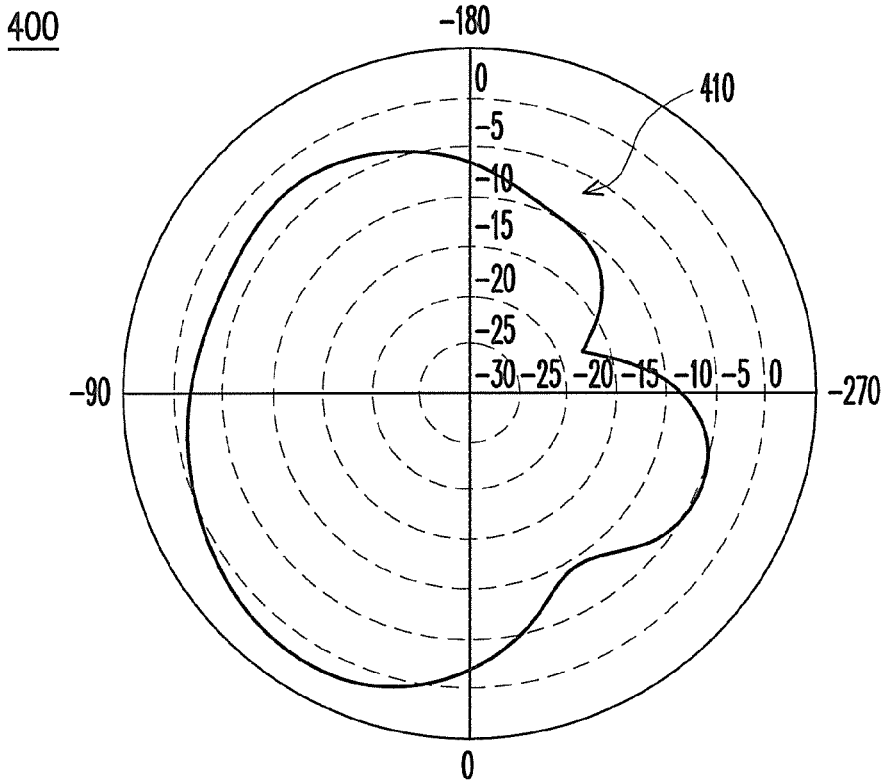
FIG. 4 is a graph showing the characteristic of one radiation pattern of the multiple antennae system according to the exemplary example.

FIG. 4 is a graph showing the characteristic of one radiation pattern of the multiple antennae system 100 according to the exemplary example of the present disclosure. Please see FIG. 4, the curve 410 of FIG. 4 shows the radiation pattern of the electromagnetic wave radiated by the first radiation conductor 131 (i.e. the first antenna) after the radiation pattern insulator 112 changes the radiation pattern of the electromagnetic wave radiated by the first radiation conductor 131.

Figure 5:
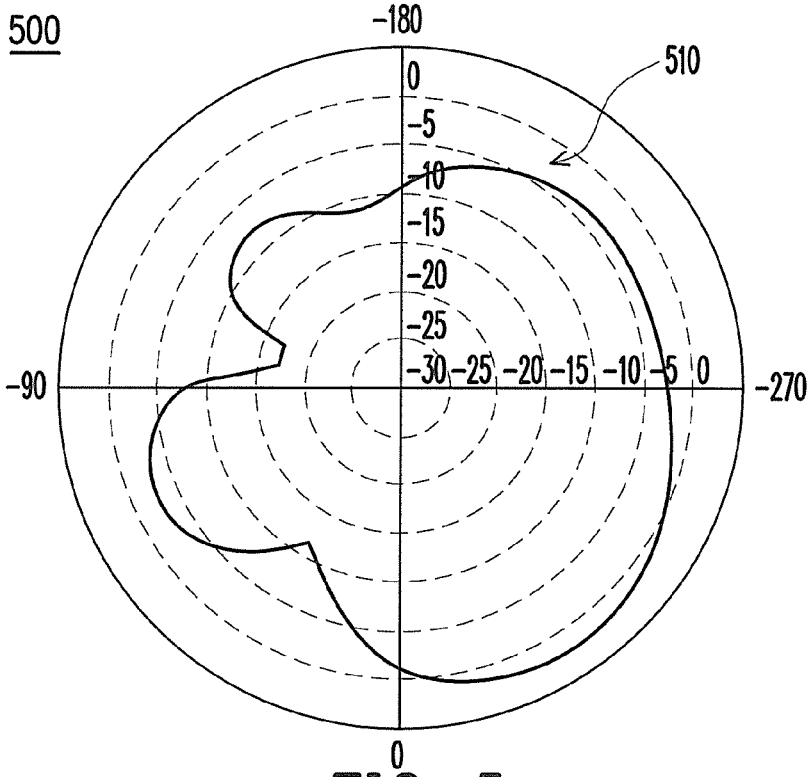
FIG. 5 is a graph showing the characteristic of another one radiation pattern of the multiple antennae system according to the exemplary example.

FIG. 5 is a graph showing the characteristic of another radiation pattern of the multiple antennae system 100 according to the exemplary example of the present disclosure. Please see FIG. 5, the curve 510 of FIG. 5 shows the radiation pattern of the electromagnetic wave radiated by the second conductor 132 (i.e. the second antenna) after the radiation pattern insulator 112 changes the radiation pattern of the electromagnetic wave radiated by the second radiation conductor 132. In addition, please see both FIG. 4 and FIG. 5, the amplitude of the electromagnetic wave on the right side in FIG. 4 is weaker (i.e. the result after the radiation pattern insulator 112 changes the radiation pattern of the electromagnetic wave radiated by the first radiation conductor 131), and the amplitude of the electromagnetic wave on the left side in FIG. 5 is weaker (i.e. the result after the radiation pattern insulator 112 changes the radiation pattern of the electromagnetic wave radiated by the second radiation conductor 132). Thus, it is obvious that the mutual coupling of the first radiation conductor 131 and the second radiation conductor 132 is weak. Furthermore, it is obvious that the radiation pattern insulator 112 reduce the mutual coupling of the first radiation conductor 131 and the second radiation conductor 132.

Figure 6:
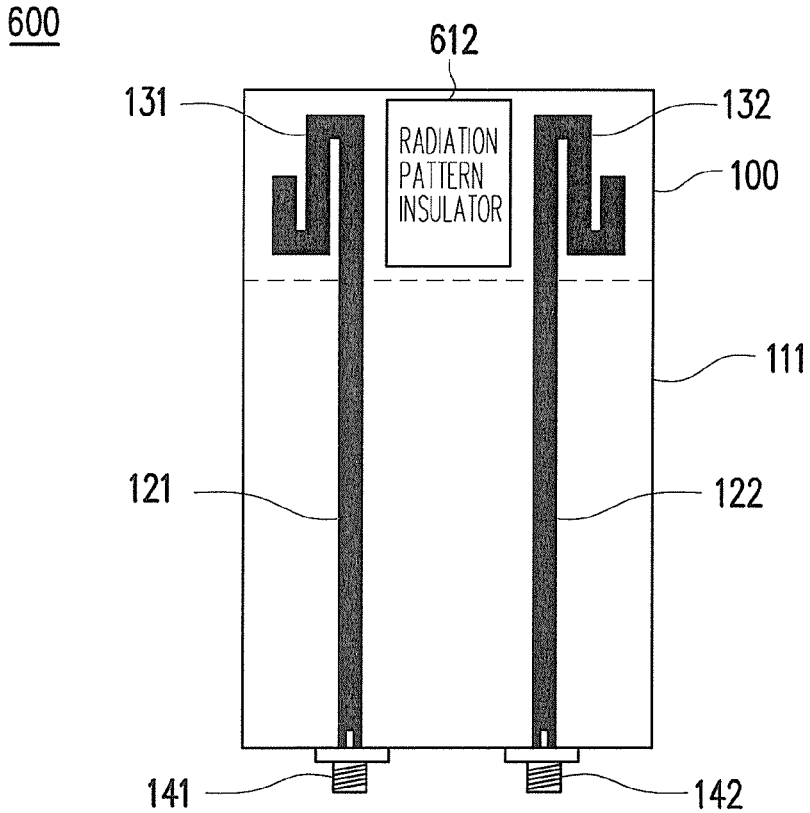
FIG. 6 is a schematic representation of the architecture of multiple antennae system according to an exemplary example.

FIG. 6 is a schematic representation of the architecture of multiple antennae system 600 according to the other exemplary example of the present disclosure. Please refer to FIG. 1 and FIG. 6. The only difference of the multiple antennae system 600 and the multiple antennae system 100 is that inner structures of the radiation pattern insulator 612 is different from that of the radiation pattern insulator 112 in FIG. 1. The other elements of the multiple antennae system 600 are the same as those of the multiple antennae system 100, and therefore are not described again.

After illustrating the elements of the multiple antennae system 100 and the multiple antennae system 600, the radiation pattern insulator 112 and the other radiation pattern insulators in FIG. 2 and FIGS. 7-12 are described as follows.

Figure 2:
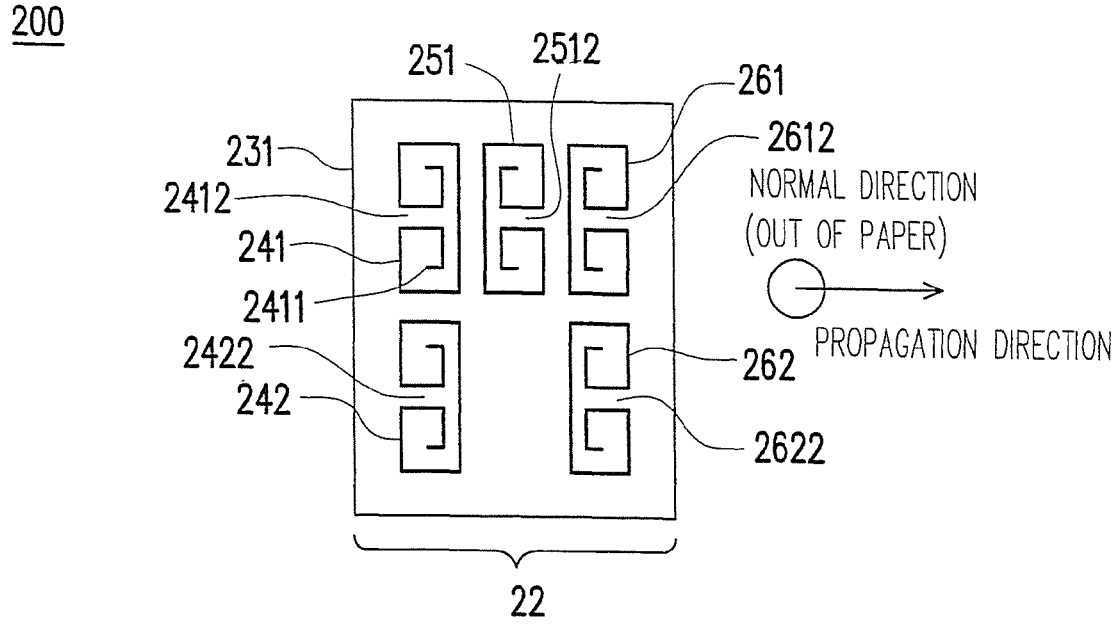
FIG. 2 is a schematic representation of the architecture of the radiation pattern insulator according to the exemplary example.

Referring to FIG. 2, FIG. 2 is a schematic representation of the architecture of the radiation pattern insulator according to the exemplary example of the present disclosure. FIG. 2 is also an enlarging schematic representation showing the radiation pattern insulator 112 of FIG. 1.

Please see FIG. 2. The radiation pattern insulator 200 comprises a dielectric substrate 231, a first radiation pattern insulation element 241, a second radiation pattern insulation element 242, a third radiation pattern insulation element 251, a fourth radiation pattern insulation element 261 and a fifth radiation pattern insulation element 262.

Referring to FIG. 1 and FIG. 2, the dielectric substrate 231 is allocated on a path for propagating radiation energy of the electromagnetic waves to be insulated by the first radiation conductor 131 and a second radiation conductor 132 of the multiple antennae system 100. The dielectric substrate 231 comprises a top surface and a bottom surface, and a normal direction (shown in FIG. 2) of the dielectric substrate 231 is substantially perpendicular to one of the propagation directions of electromagnetic waves radiated from the first radiation conductor 131 and the second radiation conductor 132. For example, the propagation directions of the electromagnetic waves radiated from the first radiation conductor 131 and the second radiation conductor 132 comprises a propagation direction from the first radiation conductor 131 to the second radiation conductor 132, and another propagation direction from the second radiation conductor 132 to the first radiation conductor 131. The normal direction of the dielectric substrate 231 is substantially perpendicular to the two propagation direction mentioned above.

Referring to FIG. 2, the first radiation pattern insulation element 241, the second radiation pattern insulation element 242, the third radiation pattern insulation element 251, the fourth radiation pattern insulation element 261, and the fifth radiation pattern insulation element 262 are the radiation pattern insulation elements of the radiation pattern insulator 200. The first radiation pattern insulation element 241, the second radiation pattern insulation element 242, the third radiation pattern insulation element 251, the fourth radiation pattern insulation element 261, and the fifth radiation pattern insulation element 262 can be allocated on the top surface or the bottom surface of the dielectric substrate 231, or alternatively, all allocated on the top surface and the bottom surface.

Please see FIG. 1 and FIG. 2. Each radiation pattern insulation element is formed by a meandering line or a wiggling line, and meandering line or the wiggling line is non-closed. In each of the following exemplary examples, the meandering line is made of conductive material, such as metal and so on. Besides, in the other exemplary example, each radiation pattern insulation element is formed by a spiral line, and the spiral line is non-closed. A total length of each meandering line of radiation pattern insulation element is 0.1 to 0.5 times the wavelength of the electromagnetic wave to be insulated by the antennae (i.e. the first radiation conductor 131 and the second radiation conductor 132) in a free space, so that a resonating frequency of each radiation pattern insulation element is approximate to a frequency of the electromagnetic wave. Furthermore, geometric patterns of the meandering lines of the radiation pattern insulation elements are similar to each other but not necessary the same, so that the resonating frequencies of the radiation pattern insulation elements may have little differences from each other, and the radiation pattern insulation elements are arranged to match an arrangement shape so as to insulate the electromagnetic waves. In addition, a distance of any two of the adjacent radiation pattern insulation elements (such as the first radiation pattern insulation element 241 and the second radiation pattern insulation element 242) is less than 0.1 times the wavelength of the electromagnetic wave to be insulated in free space.

In the exemplary example, each radiation pattern insulation element is made of one piece of meandering line or one piece of wiggling line, but the present disclosure is not limited thereto. In the other exemplary example, each radiation pattern insulation element can also made of a meandering line, a wiggling line, or a spiral line, and the meandering line, the wiggling line, or the spiral line is formed by a plurality of several lines. In addition, in the other exemplary example, when the radiation pattern insulator is implemented in several substrates, each radiation pattern insulation element of the radiation pattern insulator can be allocated on the same substrate, or each radiation pattern insulation element of the radiation pattern insulator can be allocated on the different substrate.

Please continue to see FIG. 1 and FIG. 2. A plurality of openings 2412, 2422, 2512, 2612, and 2622 of the radiation pattern insulation elements on two sides of the radiation pattern insulator 200 are toward a radiation conductor of the neighboring antennae. For example, the openings 2412, 2422, 2512, 2612, and 2622 of the radiation pattern insulation elements on the one side of radiation pattern insulator 200, such as the openings 2412, 2422 of the first radiation pattern insulation element 241 and the second radiation pattern insulation element 242, are toward the first radiation conductor 131 of the multiple antennae system 100. In the similar manner, the openings of the radiation pattern insulation elements on the other side of the radiation pattern insulator 200, such as the openings 2612, 2622 of the fourth radiation pattern insulation element 261 and the fifth radiation pattern insulation element 262, are toward the second radiation conductor 132 of the multiple antennae system 100.

In the exemplary example, the openings of the radiation pattern insulation elements not on the two sides of the radiation pattern insulator 200 can be chosen to face either direction for proper intra-element coupling. For example, the third radiation pattern insulation element 251 is not on the two sides of the radiation pattern insulator 200, and there is no difference between two orientations in the point of view of resultant coupling. Thus an opening 2512 of the third radiation pattern insulation element 251 can be chosen to face toward the first radiation conductor 131 or the second radiation conductor 132 of the multiple antennae system 100. Thus the open of the third radiation pattern insulation element 251 can be chosen to face toward the first radiation conductor 131 or the second radiation conductor 132 of the multiple antennae system 100.

In the exemplary example, the total length of the meandering line of each radiation pattern insulation element is variable. The total length of the meandering line of each radiation pattern insulation element can be adjusted according to the design of the multiple antennae system 100. That is the total length of the meandering line is not limited to be a fixed length. Besides, a meandering end of the meandering line of each radiation pattern insulation element is meandering several times. For example, the first radiation pattern insulation element 241 in FIG. 2 has at least four meanderings. Moreover, the meandering end of the meandering line of each radiation pattern insulation element is free to go around. For example, the length of the most inner end 2411 of the first radiation pattern insulation element 241 in FIG. 2 can be increased or decreased in a predefine interval, and the total length of the first radiation pattern insulation element 241 is 0.1 to 0.5 times the wavelength of the electromagnetic wave to be insulated by the antennae in a free space.

In the exemplary example, the position of the radiation pattern insulation element not on the two sides of the radiation pattern insulator is movable along with a column direction for adjust the proper intra-element coupling. For example, referring to FIG. 1 and FIG. 2, the third radiation pattern insulation element 251 of the radiation pattern insulator 200 is movable in the second column thereof. To put plainly, the position of the radiation pattern insulator 200 is movable along with a column direction parallel to the first radiation conductor 131 and the second radiation conductor 132 of the multiple antennae system 100. In other words, after the position of the third radiation pattern insulation element 251 of radiation pattern insulator 200 is moved, the third radiation pattern insulation element 251 can be allocated between the second radiation pattern insulation element 242 and the fifth radiation pattern insulation element 262.

The radiation pattern insulator 200 comprises at least two rows of the radiation pattern insulation elements and at least two columns of the radiation pattern insulation elements. In other exemplary example, the radiation pattern insulator can comprise two more rows of the radiation pattern insulation elements or two more columns of the radiation pattern insulation elements. Besides, it is noted that when a column number of the radiation pattern insulation elements of the radiation pattern insulator 200 increases, insulation and the insulation bandwidth of the radiation pattern insulator 200 increase. In short, the number, the arrangement, and the meandering manner of the radiation pattern insulation elements in radiation pattern insulator 200 are not limited thereto.

The total number of the radiation pattern insulation elements on one row of the radiation pattern insulator 200 is larger than or equal to a total number of the radiation pattern insulation elements on the other row of the radiation pattern insulator 200. For example, the first radiation pattern insulation element 241, the third radiation pattern insulation element 251, and the fourth radiation pattern insulation element 261 of the radiation pattern insulator 200 are on the first row, and the total number of the radiation pattern insulation elements on the first row is three. The second radiation pattern insulation element 242 and the fifth radiation pattern insulation element 262 of the radiation pattern insulator 200 are on the second row, and the total number of the radiation pattern insulation elements on the second row is two. It is obvious that the total number of the radiation pattern insulation elements on the first row is larger than the total number of the radiation pattern insulation elements on the second row. However, the present disclosure is not limited thereto, and in the other exemplary example the other radiation pattern insulator may applied on, wherein the total number of the radiation pattern insulation elements on one column of the radiation pattern insulator is larger than or equal to a total number of the radiation pattern insulation elements on the other column of the radiation pattern insulator.

Figure 7:
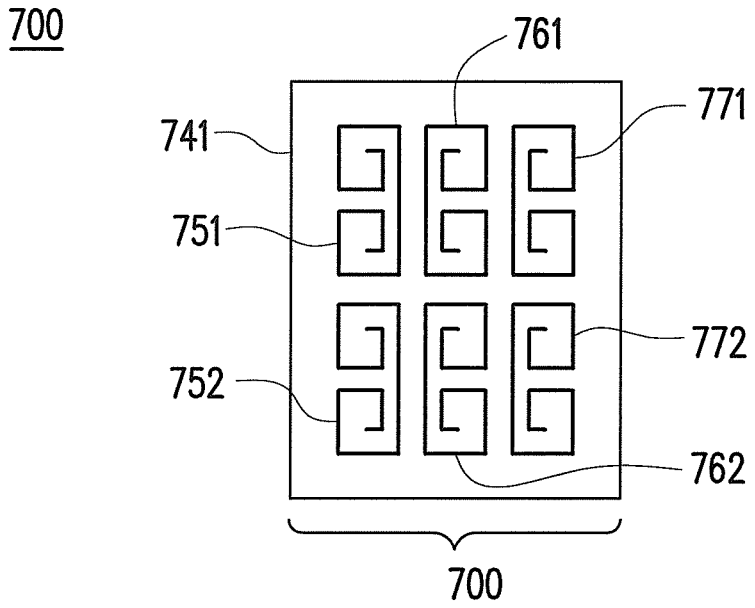
FIG. 7 is a schematic representation of the architecture of the radiation pattern insulator according to the exemplary example.

FIG. 7 is a schematic representation of the architecture of the radiation pattern insulator 700 according to the exemplary example of the present disclosure. Please see FIG. 6 and FIG. 7, the radiation pattern insulator 700 is allocated on the position of the radiation pattern insulator 600 in FIG. 6. The radiation pattern insulator 700 comprises a dielectric substrate 741, a first radiation pattern insulation element 751, a second radiation pattern insulation element 752, a third radiation pattern insulation element 761, a fourth radiation pattern insulation element 771, a fifth radiation pattern insulation element 772, and a sixth radiation pattern insulation element 762.

Please see FIG. 2 and FIG. 7, the inner structure of the radiation pattern insulator 700 in FIG. 7 is different that of the radiation pattern insulator 112 in FIG. 2, wherein the radiation pattern insulator 700 has one more radiation pattern insulation element (i.e. sixth radiation pattern insulation element 762) than radiation pattern insulator 112 has. Thus, the total number of the radiation pattern insulation elements on one row of the radiation pattern insulator 700 is equal to a total number of the radiation pattern insulation elements on the other row of the radiation pattern insulator 700.

Figure 8:
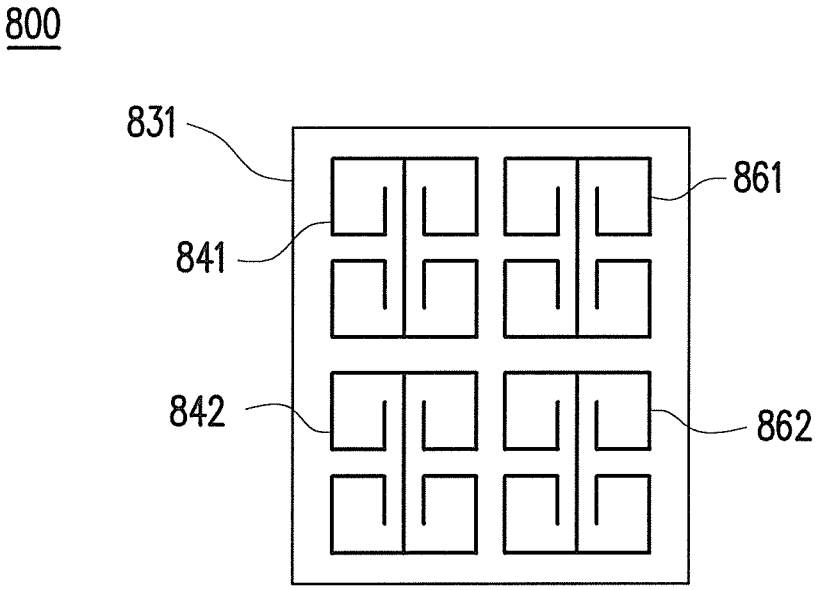
FIG. 8 is a schematic representation of the architecture of the radiation pattern insulator according to an exemplary example.

The inner structure of the radiation pattern insulator is not limited in that of the radiation pattern insulator 200 in FIG. 2 and the radiation pattern insulator 700 in FIG. 7. FIGS. 8 to 12 are used to describe the other possible inner structure of the radiation pattern insulator. Referring to FIG. 8, FIG. 8 is a schematic representation of the architecture of the radiation pattern insulator 800 according to the exemplary example of the present disclosure. In addition to a dielectric substrate 831, the radiation pattern insulator 800 further comprises a radiation pattern insulation element 841, a radiation pattern insulation element 842, a radiation pattern insulation element 861, and a radiation pattern insulation element 862. Each radiation pattern insulation element of the radiation pattern insulator 800 is similar to the combination of the first radiation pattern insulation element 241 and the second radiation pattern insulation element 251 of the radiation pattern insulator 200 in FIG. 2, but they are not the same. Thus the meandering number of the meandering line of the radiation pattern insulation element is less than that of the meandering line of first radiation pattern insulation element 241.

Figure 9:
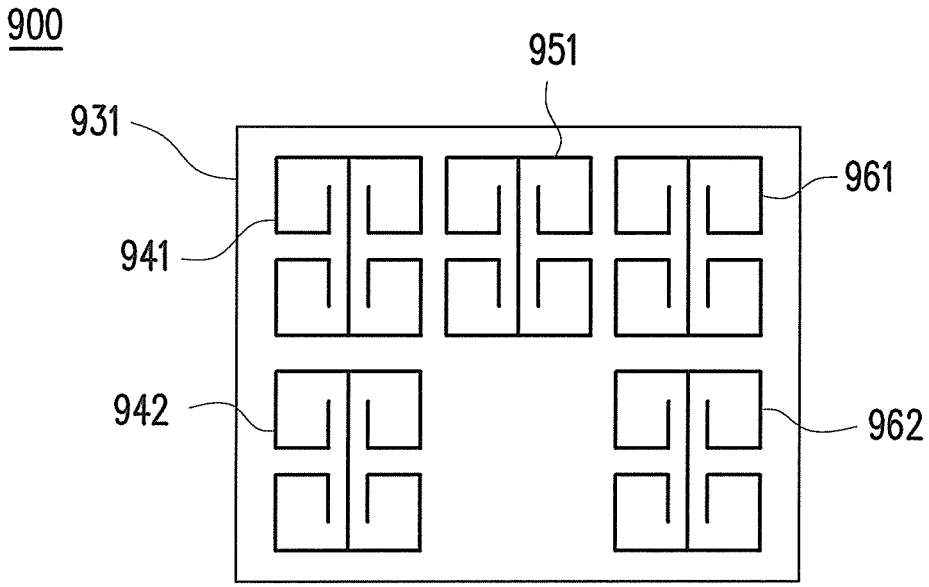
FIG. 9 is a schematic representation of the architecture of the radiation pattern insulator according to an exemplary example.

FIG. 9 is a schematic representation of the architecture of the radiation pattern insulator 900 according to the exemplary example of the present disclosure. Please see FIG. 8 and FIG. 9, the difference of FIG. 8 and FIG. 9 is that the radiation pattern insulator 900 in FIG. 9 has one more row of the radiation pattern insulation elements than the radiation pattern insulator 800 has in FIG. 8. In other words, an additive radiation pattern insulation element 951 is allocated on the radiation pattern insulator 900.

Figure 10:
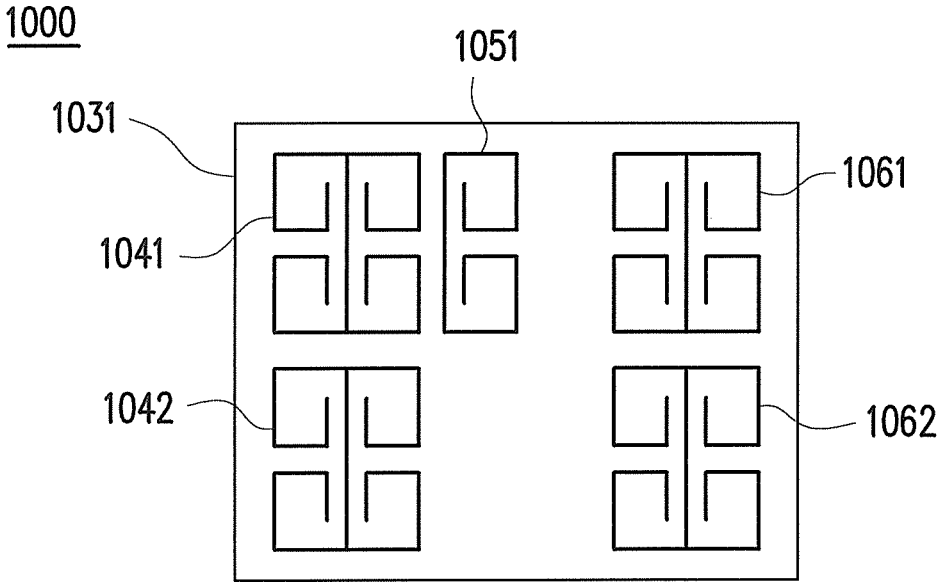
FIG. 10 is a schematic representation of the architecture of the radiation pattern insulator according to an exemplary example.

FIG. 10 is a schematic representation of the architecture of the radiation pattern insulator 1000 according to the exemplary example of the present disclosure. Please see FIG. 2, FIG. 9, and FIG. 10, the difference of FIG. 9 and FIG. 10 is that the radiation pattern insulation element 951 on the middle column of the radiation pattern insulator 900 in FIG. 9 is substituted by the radiation pattern insulation element 1051 of the radiation pattern insulator 1000 in FIG. 10. Furthermore, the radiation pattern insulation element 1051 is similar to the third radiation pattern insulation element 251, but much different from the radiation pattern insulation element 951.

Figure 11:
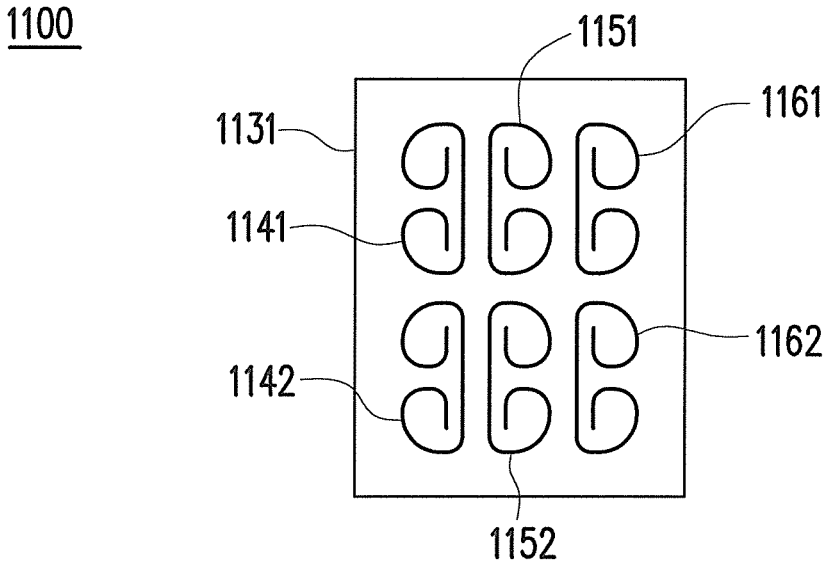
FIG. 11 is a schematic representation of the architecture of the radiation pattern insulator according to an exemplary example.
Figure 12:
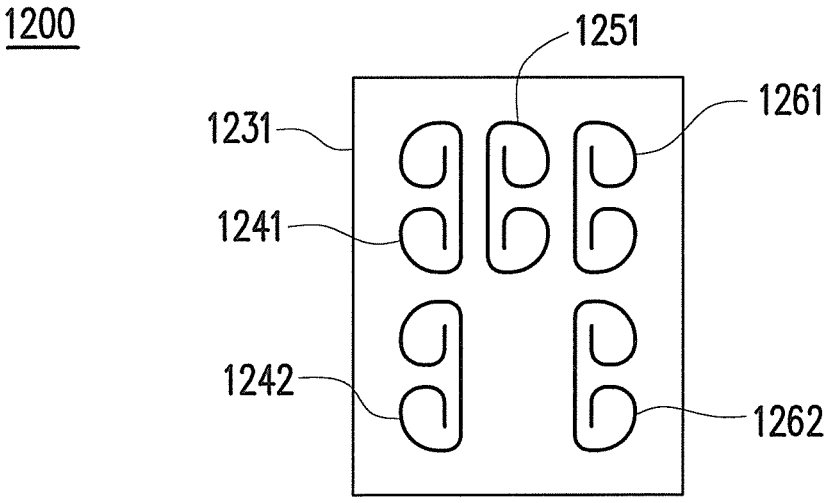
FIG. 12 is a schematic representation of the architecture of the radiation pattern insulator according to an exemplary example.

The implementation manner is not limited in the meandering lines of the radiation patterns insulation elements with the right angle patterns shown in FIG. 2, FIG. 7, and FIG. 10. FIG. 11 and FIG. 12 are used to illustrate the meandering lines of the radiation patterns insulation elements without the right angle patterns.

FIG. 11 is a schematic representation of the architecture of the radiation pattern insulator 1100 according to the exemplary example of the present disclosure. Please see FIG. 7 and FIG. 11, the arrangement of the radiation pattern insulation elements of the radiation pattern insulator 1100 in FIG. 11 is similar to that of the radiation pattern insulator 700 in FIG. 7, but the meandering line of each radiation pattern insulation element of radiation pattern insulator 1100 is a not right angle pattern.

FIG. 12 is a schematic representation of the architecture of the radiation pattern insulator according to the exemplary example of the present disclosure. Please see FIG. 2 and FIG. 12, the arrangement of the radiation pattern insulation elements of the radiation pattern insulator 1200 in FIG. 12 is similar to that of the radiation pattern insulator 200 in FIG. 2, but the meandering line of each radiation pattern insulation element of radiation pattern insulator 1200 is a not right angle pattern. The pattern of the meandering line of the radiation pattern insulation element is not limited in that described in FIGS. 1 to 7, and in the other exemplary example, the patter the meandering line of the radiation pattern insulation element may that of the other meandering line of different kind.

In those exemplary examples, the radiation pattern insulation element of the radiation pattern insulator can be made of meta-material, wherein one of the permittivity and the permeability of meta-material is a negative value, and thus the meta-material is also called as the single negative material. The propagation coefficient of the single negative material is an imaginary number. When the radiation pattern insulation element made of the single negative material is allocated parallel to the antennae, it has insulation of the electromagnetic waves on the single direction. In addition, when the single negative material is applied on the radiation pattern insulator, the radiation pattern insulator can be allocated parallel to the antennae, and thus a full planar design can be adopted. When the single negative material is applied on the radiation pattern insulator, the required area and height of the antennae can be reduced, so that the distance between the antennae can be reduced to 0.18 times the wavelength of the electromagnetic wave to be insulated by the antennae in the free space. Moreover, when the single negative material is applied on the radiation pattern insulator, the radiation pattern insulator can be implemented via a process of the printed circuit board, wherein the printed circuit board comprises a single substrate structure or a multiple substrates structure.

Figure 13:
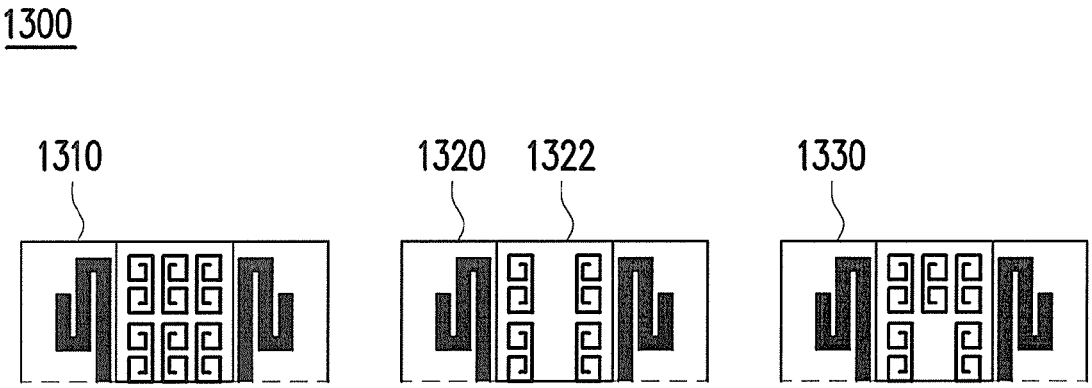
FIG. 13 is a schematic representation of the architectures of three multiple antennae systems according to the exemplary example.

Please see FIG. 2, FIG. 7, and FIG. 13, FIG. 13 is a schematic representation of the architectures of three multiple antennae systems according to the exemplary example of the present disclosure. In FIG. 13, the multiple antennae system 1310 comprises a radiation pattern insulator 700 in FIG. 7, and the multiple antennae system 1330 comprises the radiation pattern insulator 200 in FIG. 2. Besides, the multiple antennae system 1320 in FIG. 13 comprises the radiation pattern insulator 1322 similar to a specific radiation pattern insulator. The specific radiation pattern insulator is formed similar to the radiation pattern insulator 700 after the radiation pattern insulation element on the middle column is removed, so only two columns of the radiation pattern insulation elements neighboring to the antennae (or radiation conductors) are left. In addition, the distance of two columns of the radiation pattern insulation elements of the radiation pattern insulator 1322 is the distance of the width of at least one column of the radiation pattern insulation elements.

Figure 14:
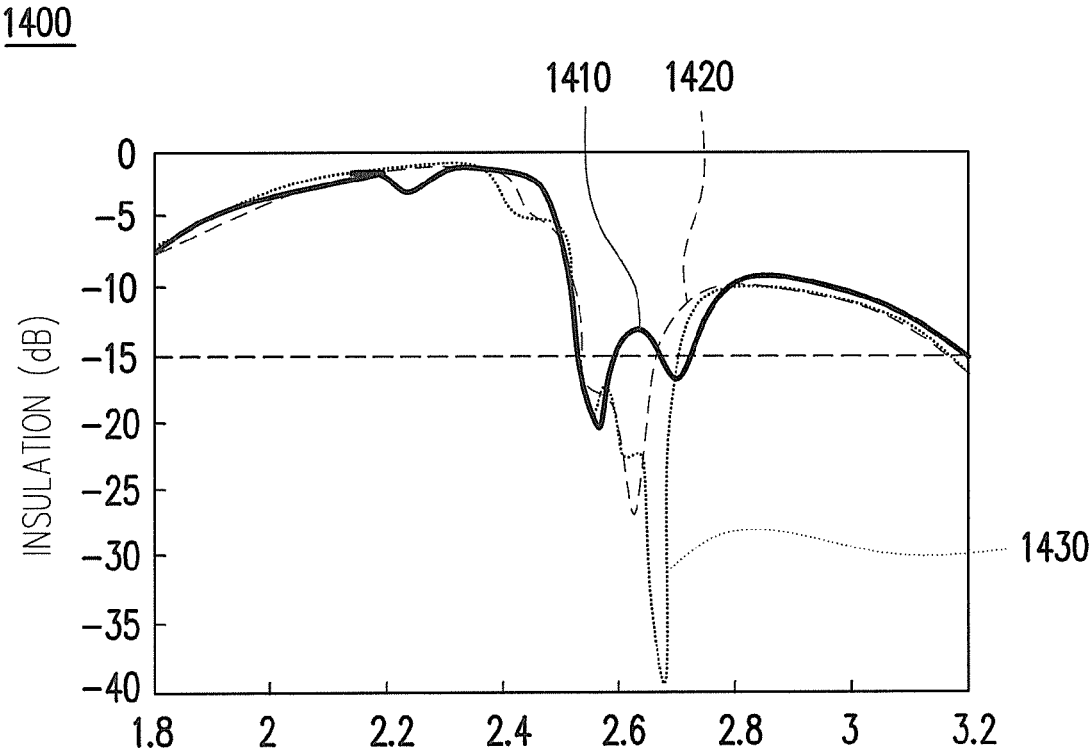
FIG. 14 is a graph showing the characteristic of insulation of the three multiple antennae systems.

Please see FIG. 13 and FIG. 14, FIG. 14 is a graph showing the characteristic of insulation of the radiation pattern insulators in the three multiple antennae systems of FIG. 13. FIG. 14 shows the experimental insulation of the radiation pattern insulators of the multiple antennae systems 1310, 1320, and 1330 in the 1.8 GHz to 3.2 GHz frequency band. It is noted that, herein the target frequency 2.6 GHz of the electromagnetic waves to be insulated is assumed, and the lowest acceptable level −15 dB of the insulation is also assumed. In the foregoing assumptions, the curve 1410 of FIG. 14 shows that insulation of the radiation pattern insulator 700 of the multiple antennae system 1410 is not very good, since the insulation of the radiation pattern insulator 700 among the three the radiation pattern insulators in FIG. 13 is less on the frequency 2.6 GHz. The curve 1420 of FIG. 14 shows that insulation of the radiation pattern insulator 1322 of the multiple antennae system 1410 is acceptable, but the insulation bandwidth is narrow. The curve 1430 of FIG. 14 shows that insulation of the radiation pattern insulator 1322 of the multiple antennae system 1410 is appreciable, because the insulation and insulation bandwidth are larger than those of the other two radiation pattern insulators. However the characteristic of insulation shown in FIG. 14 is an experimental result under a specific circumstance, and the characteristic of insulation is not used to limit the present disclosure. In the different circumstances or the systems, the insulation and the insulation bandwidth radiation pattern insulator 700 or the radiation pattern insulator 1322 may larger than those of the other radiation pattern insulators. Therefore the structure of the radiation pattern insulator in multiple antennae system can be designed based upon the adopted communication system.

Figure 15:
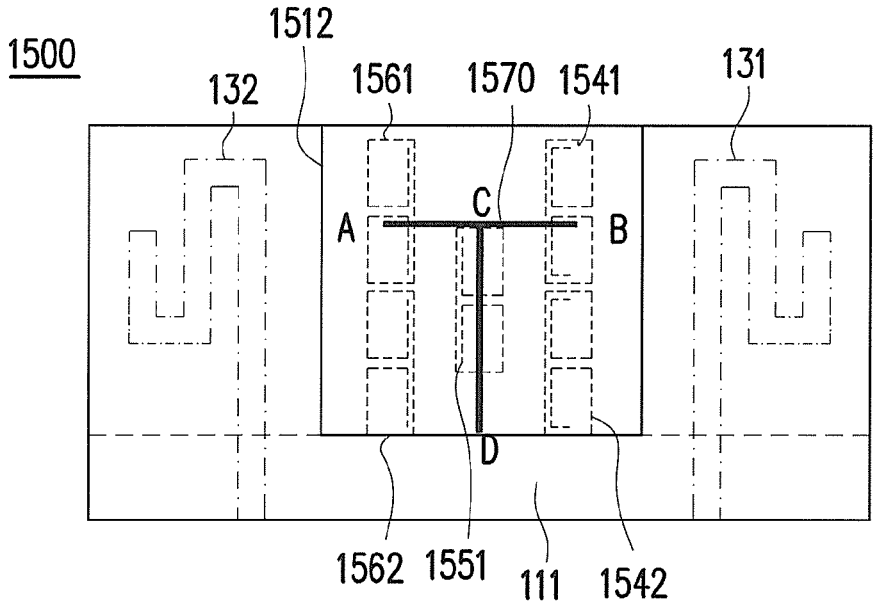
FIG. 15 is a schematic representation of the architecture of the multiple antennae system according to an exemplary example.

FIG. 15 is a schematic representation of the architecture of the multiple antennae system according to the exemplary example of the present disclosure. Please refer to FIG. 6 and FIG. 15, the multiple antennae system 1500 in FIG. 15 has a first radiation conductor 131, a second radiation conductor 132, and a radiation pattern insulator 1512 all allocated on the first surface of the conductor ground surface 111. The radiation pattern insulator 1512 is similar to the radiation pattern insulator 600 in FIG. 6. The radiation pattern insulator 1512 comprises the first radiation conductor 131, the second radiation conductor 132, a first radiation pattern insulation element 1541, a second radiation pattern insulation element 1542, a third radiation pattern insulation element 1551, a fourth radiation pattern insulation element 1561, and a fifth radiation pattern insulation element 1562. The first radiation conductor 131, the second radiation conductor 132, the first radiation pattern insulation element 1541, the second radiation pattern insulation element 1542, the third radiation pattern insulation element 1551, the fourth radiation pattern insulation element 1561, and the fifth radiation pattern insulation element 1562 are all allocated on the first surface of the conductor ground surface 111. In the exemplary example, the first radiation conductor 131, the second radiation conductor 132, the first radiation pattern insulation element 1541, the second radiation pattern insulation element 1542, the third radiation pattern insulation element 1551, the fourth radiation pattern insulation element 1561, and the fifth radiation pattern insulation element 1562 are all allocated on the same surface. FIG. 15 is a vertical view of the second surface (opposite surface of the first surface), and thus the elements mentioned above are present by using the dotted lines in FIG. 15. The difference of the radiation pattern insulator 1512 and the radiation pattern insulator 600 is that a tree shape radiation pattern insulator 1570 is allocated on the second surface of the conductor ground surface 111 of the radiation pattern insulator 1512.

In another exemplary example, the tree shape radiation pattern insulator 1570 is a structure unit of T shape, and the structure unit of T shape comprises a first part (the part of the line formed by the points A, B, and C) and a second part (the part of the line formed by the points C and D), wherein the first part and the second part are coupled to each other at the point C. In the exemplary example, the length of the first part of the tree shape radiation pattern insulator 1570 is less than the length of one of the two sides of the radiation pattern insulator 1512. For example, the half length of the first part is six millimeters. In addition, the tree shape radiation pattern insulator 1570 can be extended from the conductor ground surface 111. In other words, the tree shape radiation pattern insulator 1570 is coupled to the conductor ground surface 111. When the tree shape radiation pattern insulator 1570 operates with the radiation pattern insulation element made of meta-material, a plurality of the resonance modes are generated, so as to achieve the effect of broadband insulation. Furthermore, tree shape radiation pattern insulator 1570 changes the mutual coupling of the electromagnetic waves radiated from the first radiation conductor 131 and the second radiation conductor 132 of the multiple antennae system 1500, and therefore the third radiation pattern insulation element 1551 is allocated on the position lower than the line formed by the points A, B, and C. However, the present disclosure is not limited thereto, and in the other exemplary example, according to the requirement of the radiation pattern insulator, the tree shape radiation pattern insulator 1570 may be a structure unit of quasi T shape, or be a structure unit of quasi Y shape. Furthermore, in the other exemplary example, the length of the tree shape radiation pattern insulator 1570 may be the other length but not six millimeters, and the length of the tree shape radiation pattern insulator 1570 is determined according to the requirement of the radiation pattern insulator.

Figure 16:
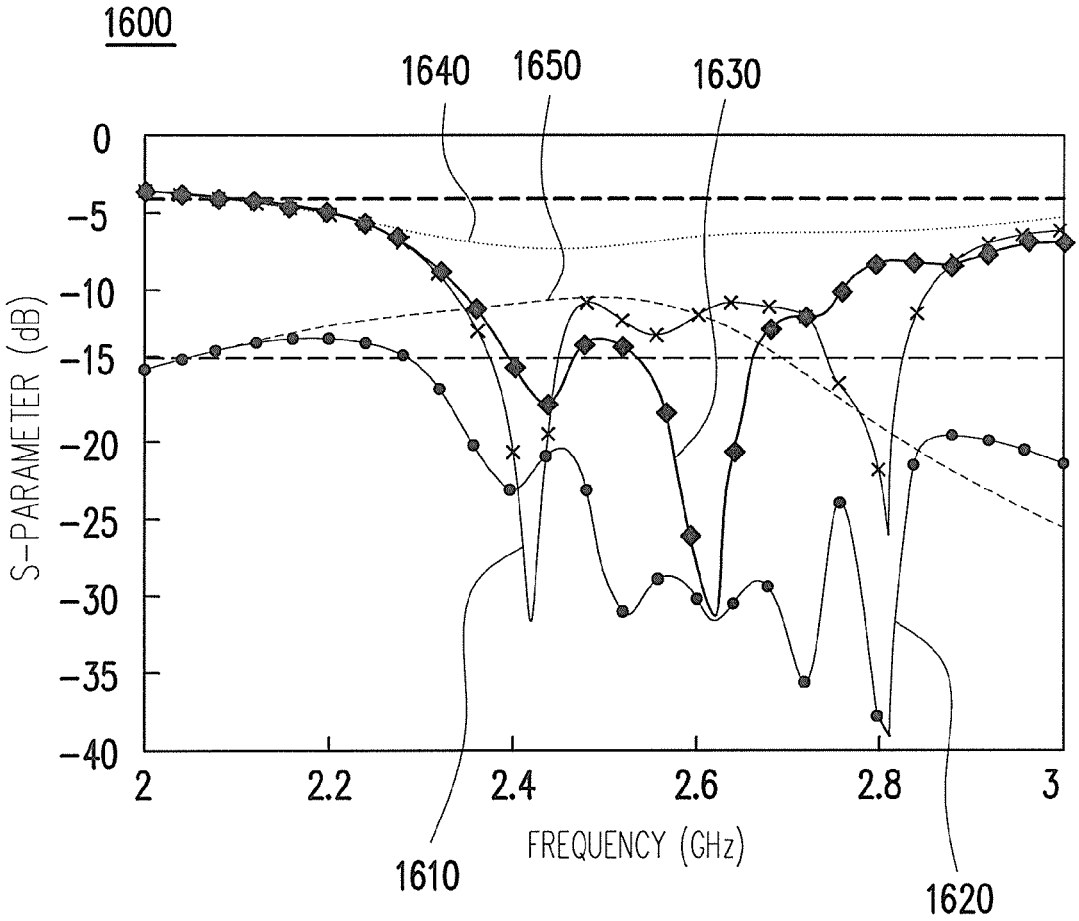
FIG. 16 is a graph showing the curves of the return loss and the coupling coefficient of the multiple antennae system according to the exemplary example.

FIG. 16 is a graph showing the curves of the return loss and the coupling coefficient of the multiple antennae system according to the exemplary example of the present disclosure. It is noted that, FIG. 16 shows the mutual coupling and the return losses of the first radiation conductor 131 and the second radiation conductor 132 after the radiation pattern insulator 1512 of the multiple antennae system 1500 reduces the mutual coupling of the first radiation conductor 131 and the second radiation conductor 132. In addition, FIG. 16 also shows the mutual coupling and the return losses of the first radiation conductor 131 and the second radiation conductor 132 when the radiation pattern insulator 1512 of the multiple antennae system 1500 does not reduce the mutual coupling of the first radiation conductor 131 and the second radiation conductor 132. Referring to FIG. 16, the curve 1610 of FIG. 16 presents the return loss of the first radiation conductor 131 under the condition that the radiation pattern insulator 1512 is allocated on the multiple antennae system 1500. The curve 1620 of FIG. 3 presents the coupling coefficient of the first radiation conductor 131 and the second radiation conductor 132 under the condition that the radiation pattern insulator 1512 is allocated on the multiple antennae system 1500. The curve 1630 of FIG. 16 presents the return loss of the second radiation conductor 132 under the condition that the radiation pattern insulator 1512 is allocated on the multiple antennae system 1500. The curve 1640 of FIG. 16 presents the return loss of the first radiation conductor 131 and the second radiation conductor 132 under the condition that no radiation pattern insulator is allocated on the multiple antennae system 1500. The curve 1650 of FIG. 3 presents the coupling coefficient of the first radiation conductor 131 and the second radiation conductor 132 under the condition that no radiation pattern insulator is allocated on the multiple antennae system 1500. In addition, in FIG. 2, FIG. 14, and FIG. 16, it is obvious that the insulation bandwidth of the multiple antennae system 1500 having the tree shape radiation pattern insulator 1570 allocated thereon is larger than that of the multiple antennae system without the tree shape radiation pattern insulator. For example, the insulation bandwidth of the multiple antennae system 1330 having the radiation pattern insulator 200 is less than that of the multiple antennae system 1500. Furthermore, after actual measurement, when the radiation pattern insulator 1512 is allocated on the multiple antennae system 1500, a 19.2% increment of insulation bandwidth is obtained.

Figure 17:
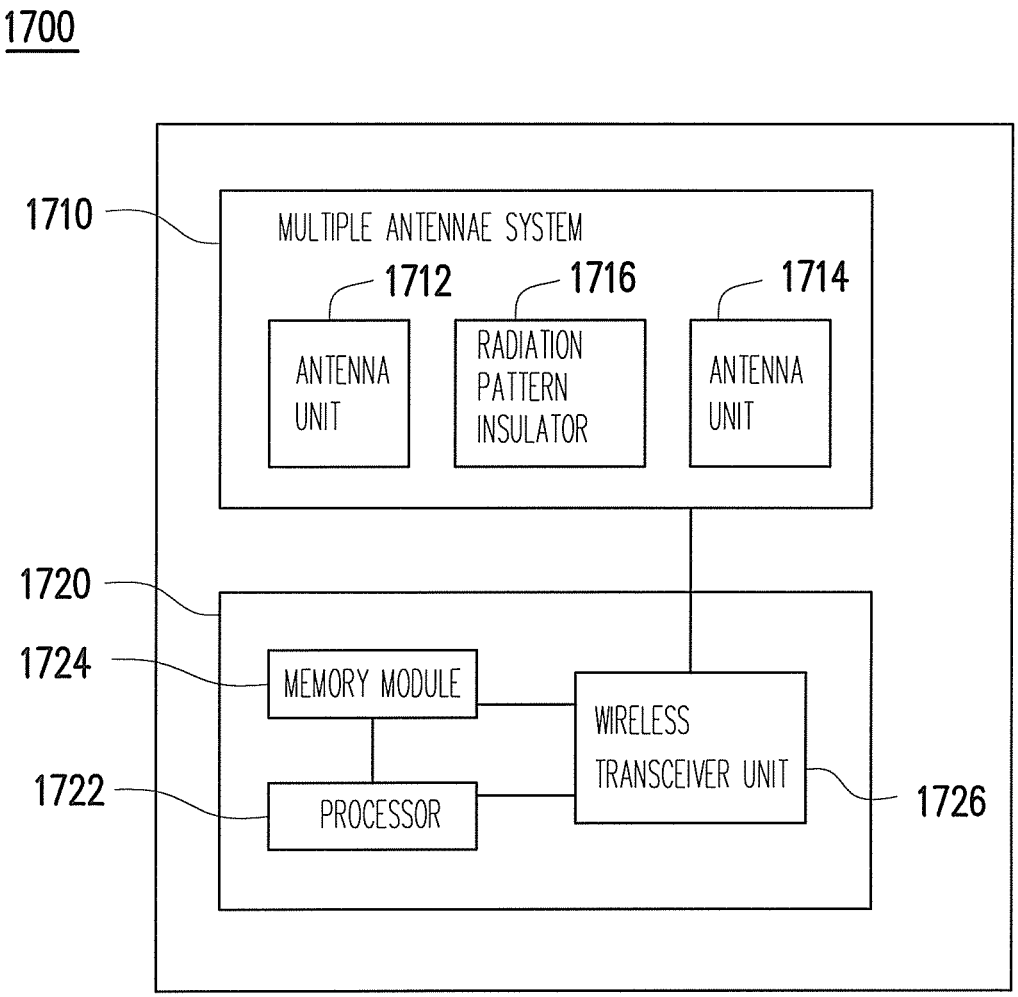
FIG. 17 is a schematic representation of the architecture of the communication device using the multiple antennae system according to an exemplary example.

Referring to FIG. 17, FIG. 17 is a schematic representation of the architecture of the communication device using the multiple antennae system according to another exemplary example of the present disclosure. The communication device is a communication device adopting a multiple input multiple output transmission technology, a communication device having a plurality of high frequency antenna units. Referring to FIG. 15, the communication device 1700 comprises a multiple antennae system 1710 and the wireless communication unit 1720. The multiple antennae system 1710 receives or transmits a plurality of wireless signals, and the wireless communication unit processes the received wireless signals or the wireless signals to be transmitted.

Referring to FIG. 17, the multiple antennae system 1710 comprises two antenna units 1712 and 1714, and a radiation pattern insulator 1716. The antenna units 1712 and 1714 are monopole antennae and can comprise the microstrip lines, the radiation conductors, and the feed-in ends mentioned in these exemplary examples, however the present disclosure is not limited thereto. Furthermore, the radiation pattern insulator 1716 can be the radiation pattern insulator mentioned in one the first to eighth exemplary examples, but the present disclosure is not limited thereto. In the other exemplary example, the multiple antennae system may further more than two antenna units and more than one radiation pattern insulator.

Please refer to FIG. 8, the wireless communication unit 1720 comprises a processor 1722, a memory module 1724, and a wireless transceiver unit 1726.

In the other exemplary example, the wireless transceiver unit 1726 transmits the upload data to the wireless access point (not shown) by using the multiple antennae system 1710, and receives the download data from the wireless access point by using the multiple antennae system 1710. Furthermore, the person skilled in art can know the wireless transceiver unit 1726 comprises a channel encoder (not shown), a channel decoder (not shown), a multiplexer (not shown), a de-multiplexer (not shown), a digital-to-analog converter (not shown), a modulator (not shown), a demodulator (not shown), and a power amplifier (not shown). Furthermore, the upload and download data transmitted or received by wireless transceiver unit 1726 comprise the general data and the data of the communication standard stored in the memory module 1724.

The general data and the data of the communication standard are stored in the memory module 1724. In addition, the memory module 1724 can also store the program module. When the program module is executed by the processor 1722, the processor 1722 and the elements coupled thereof can complete one or more steps of the program, wherein these steps for example are the negotiation process of communication protocol, the process of data transmission, the process of system operation and so on. The memory module 1724 can be one or more memory device which are used to store data and the program, and may comprise the RAM, ROM, FLASH, magnetic storage tape, or optic storage device. The processor 1722 can be a configured processor or a plurality of configured processors, and the processor 1722 is used to execute the program module, to process the data of the communication standard, and to control the wireless transceiver unit 1726.

Accordingly, the illustrated exemplary examples provide the radiation pattern insulator having characteristic of broadband and the capability for insulating the high frequency electromagnetic wave, the multiple antennae system using the radiation pattern insulator, and the communication device using the multiple antennae system. When the radiation pattern insulator co-works with the multiple antennae, since the resonating frequencies of the inner radiation pattern insulation elements are approximate to the frequency of the electromagnetic waves, and the have little difference, the radiation pattern insulator has a characteristic of broadband, and can change the radiation patter of the electromagnetic waves radiated from the neighboring antennae, so as to reduce the mutual coupling of the neighboring antennae and the correlation of the electromagnetic waves radiated from the neighboring antennae.

It will be apparent to those skilled in the art that various modifications and variations can be made to the structure of the present invention without departing from the scope or spirit of the invention. In view of the foregoing descriptions, it is intended that the present invention covers modifications and variations of this invention if they fall within the scope of the following claims and their equivalents.

What is claimed is:

1. A uniplanar radiation pattern insulator, comprising:

a dielectric substrate, allocated between a plurality of antennae, wherein the dielectric substrate comprises a top surface and a bottom surface, and a normal direction of the dielectric substrate is substantially perpendicular to propagation directions of a plurality of electromagnetic waves radiated from the antennae; and a plurality of uniplanar radiation pattern insulation elements, allocated on the top surface or the bottom surface of the dielectric substrate, wherein the uniplanar radiation pattern insulation elements are located in one plane and are not grounded and are arranged in at least three columns;

wherein the at least three columns comprises two side columns and at least one inner column; and wherein a number of the uniplanar radiation pattern insulation elements arranged in each of at least one inner column is less than a number of the uniplanar radiation pattern elements arranged in each of the two side columns.

2. The uniplanar radiation pattern insulator according to claim 1, wherein the dielectric substrate is allocated on a path for propagating radiation energy of the electromagnetic waves to be insulated.

3. The uniplanar radiation pattern insulator according to claim 1, wherein each of the uniplanar radiation pattern insulation elements is formed by a meandering line or a wiggling line, the meandering line or the wiggling line is non-closed, and the meandering line or the wiggling line is made of conductive material.

4. The uniplanar radiation pattern insulator according to claim 3, wherein a total length of each meandering line of the uniplanar radiation pattern insulation elements is 0.1 to 0.5 times the wavelength of the electromagnetic wave to be insulated in a free space, so that a resonating frequency of each uniplanar radiation pattern insulation element is approximate to a frequency of the electromagnetic wave.

5. The uniplanar radiation pattern insulator according to claim 4, wherein geometric patterns of the meandering lines of the uniplanar radiation pattern insulation elements are similar to each other, so that the resonating frequencies of the uniplanar radiation pattern insulation elements have little differences from each other, and the uniplanar radiation pattern insulation elements are arranged to match an arrangement shape so as to insulate the electromagnetic waves.

6. The uniplanar radiation pattern insulator according to claim 5, wherein a distance of any two of the adjacent uniplanar radiation pattern insulation elements is less than 0.1 times the wavelength of the electromagnetic wave in free space.

7. The uniplanar radiation pattern insulator according to claim 3, wherein a total length of the meandering line of each uniplanar radiation pattern insulation element is variable, and a meandering end of the meandering line of each uniplanar radiation pattern insulation element is meandering several times.

8. The uniplanar radiation pattern insulator according to claim 3, wherein a meandering end of the meandering line of each uniplanar radiation pattern insulation element is free to go around.

9. The uniplanar radiation pattern insulator according to claim 1, wherein a plurality of openings of the uniplanar radiation pattern insulation elements on two sides of the uniplanar radiation pattern insulator are toward a radiation conductor of the neighboring antennae.

10. The uniplanar radiation pattern insulator according to claim 1, wherein the radiation pattern insulator comprises at least two columns of the uniplanar radiation pattern insulation elements and at least two rows of the uniplanar radiation pattern insulation elements; and a total number of the uniplanar radiation pattern insulation elements on one row is larger than or equal to a total number of the uniplanar radiation pattern insulation elements on the other row.

11. The uniplanar radiation pattern insulator according to claim 1, wherein each of the uniplanar radiation pattern insulation elements is made of meta-material.

* * * * *